US008613382B2

(12) United States Patent
Jung

(10) Patent No.: US 8,613,382 B2
(45) Date of Patent: Dec. 24, 2013

(54) STAPLING APPARATUS

(75) Inventor: Kijo Jung, Seoul (KR)

(73) Assignee: Biztechone Co., Ltd., Seoul (KR)

( * ) Notice: Subject to any disclaimer, the term of this patent is extended or adjusted under 35 U.S.C. 154(b) by 273 days.

(21) Appl. No.: 13/188,005

(22) Filed: Jul. 21, 2011

(65) Prior Publication Data

US 2012/0037685 A1 Feb. 16, 2012

(30) Foreign Application Priority Data

Aug. 12, 2010 (KR) ..... 10-2010-0077877

(51) Int. Cl.
*B27F 7/17* (2006.01)

(52) U.S. Cl.
USPC ..... 227/156

(58) Field of Classification Search
None
See application file for complete search history.

(56) References Cited

U.S. PATENT DOCUMENTS 4,410,170 A * 10/1983 Wertheimer et al. ..... 270/37
4,928,941 A * 5/1990 Uto et al. ..... 270/58.14
5,330,086 A * 7/1994 Shimomura et al. ..... 227/7
2004/0079782 A1* 4/2004 Luo ..... 227/131
2012/0038100 A1* 2/2012 Jung ..... 271/182

FOREIGN PATENT DOCUMENTS

KR 10-0499900 A 9/2005

* cited by examiner

*Primary Examiner* — Brian D Nash
(74) *Attorney, Agent, or Firm* — Birch, Stewart, Kolasch & Birch, LLP

(57) ABSTRACT

Disclosed is a stapling apparatus having an improved structure capable of smoothly rotating a stapler at both lateral sides of the stapling apparatus. The stapling apparatus includes a base frame including a horizontal slot, branch slots branching from the horizontal slot, rotation restricting plates protruding from a branch portion between the branch slots and the horizontal slot, respectively, and a movement guide shaft provided in parallel to the horizontal slot, a movable frame movable to a left or a right on the base frame, and a bucket for rotating a stapler, in which a pair of first guide rollers fitted into the horizontal slot and a second guide roller protruding to an outside of the horizontal slot are fixed to a lower portion of the bucket, and one of the first guide rollers is guided to move to the branch slot from the horizontal slot.

7 Claims, 9 Drawing Sheets

STAPLING APPARATUS

BACKGROUND OF THE INVENTION

1. Field of the Invention

The present invention relates to a stapling apparatus capable of stapling a paper discharged from an image forming apparatus such as a printer or a copy machine, thereby finishing the paper. More particularly, the present invention relates to a stapling apparatus capable of stapling a paper at left and right corners and a straight-line section thereof.

2. Description of the Related Art

In general, as shown in FIG. 1, an image forming apparatus such as a copy machine 1 is provided at a side portion thereof with a paper finishing device 2 to finish a paper discharged from the image forming apparatus.

The paper finishing device 2 may stack a paper copied and discharged from the image forming apparatus 1 on an upper tray 6, or may stack a paper, which has been subject to a predetermined work such as copy, on a lower tray 7 after punching the paper by using a punch 5 or stapling the paper by using a stapler 24.

A stapling apparatus constituting the paper finishing device 2 has been developed in various structures to staple a paper transferred thereto while straightly moving along one side of the paper or to staple the corner of the paper at an angle of 45 degrees.

However, the conventional stapling apparatus has disadvantages in terms of reliability and lowers the stability when the stapler moves corner regions.

SUMMARY

Accordingly, the present invention has been made to solve the above-mentioned problems occurring in the prior art, and an object of the present invention is to provide a stapling apparatus capable of smoothly moving a stapler at a corner.

Another object of the present invention is to provide a stapling apparatus capable of stapling both corners of a paper at a predetermined angle by obliquely arranging staplers at both lateral sides of the stapling apparatus.

Still another object of the present invention is to provide a stapling apparatus having an improved structure capable of smoothly rotating a stapler at both lateral sides of the stapling apparatus.

To accomplish the above objects of the present invention, there is provided a stapling apparatus including a base frame including a horizontal slot, branch slots that branch from inner portions of the horizontal slot while being spaced apart from both end portions of the horizontal slot by a predetermined distance, rotation restricting plates protruding from a branch portion between the branch slots and the horizontal slot, respectively, and a movement guide shaft provided in parallel to the horizontal slot, a movable frame movable to a left or a right on the base frame along the movement guide shaft mounted on the base frame and provided at a central portion thereof with a guide passage having a substantially C shape, a bucket for rotating a stapler, in which a pair of first guide rollers fitted into the horizontal slot through both end portions of the substantially C-shape guide passage formed in the movable frame, and a second guide roller protruding to an outside of the horizontal slot through a central portion of the substantially C-shape guide passage formed in the movable frame are fixed to a lower portion of the bucket, and one of the first guide rollers moving along the horizontal slot is guided to move to the branch slot from the horizontal slot when the second guide roller makes contact with the rotation restricting plate, and a stapler fixed onto the bucket for rotating the stapler.

In addition, the substantially C-shape guide passage formed in the movable frame is configured to restrict movement of the first guide rollers and one second guide roller fixed to the lower portion of the bucket for rotating the stapler.

In addition, the substantially C-shape guide passage formed in the movable frame is configured to allow the first guide rollers to move while making contact with both end portions of the substantially C-shape guide passage when the second guide roller fixed to the lower portion of the bucket for rotating the stapler is positioned at the central portion of the substantially C-shape guide passage.

In addition, each branch slot branching from the horizontal slot includes an inclined portion inclined with respect to the horizontal slot at a predetermined angle and a parallel portion parallel to the horizontal slot.

In addition, the stapling apparatus further includes a driving belt installed on the base frame to rotate in parallel to the movement guide shaft, and the movable frame is fixed to the driving belt to reciprocate along the movement guide shaft.

In addition, the second guide roller maintains a predetermined distance from the base frame if the second guide roller is positioned out of a region of the rotation restricting plate.

As described above, according to the present invention, the bucket for rotating the stapler can be smoothly rotated at the corner by providing the stapling apparatus including a base frame including a horizontal slot, branch slots that branch from inner portions of the horizontal slot while being spaced apart from both end portions of the horizontal slot by a predetermined distance, rotation restricting plates protruding from a branch portion between the branch slots and the horizontal slot, respectively, and a movement guide shaft provided in parallel to the horizontal slot, a movable frame movable to a left or a right along the movement guide shaft mounted on the base frame and provided at a central portion thereof with a guide passage having a substantially C shape, and a bucket for rotating a stapler, in which a pair of first guide rollers fitted into the horizontal slot through both end portions of the substantially C-shape guide passage formed in the movable frame and a second guide roller protruding to an outside of the horizontal slot through a central portion of the substantially C-shape guide passage formed in the movable frame are fixed to a lower portion of the bucket, and one of the first guide rollers moving along the horizontal slot is guided to move to the branch slot from the horizontal slot when the second guide roller makes contact with the rotation restricting plate.

In addition, the stapler can staple the corners of a paper at various angles by properly restricting the rotation of the bucket, which is used for rotating the stapler, at the corner.

DETAILED DESCRIPTION OF THE EMBODIMENTS

Figure 1:
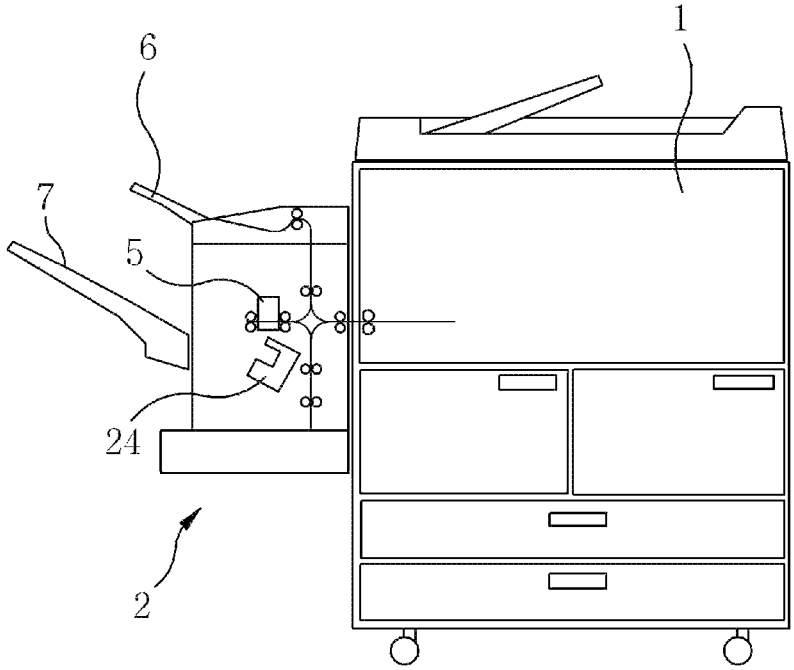
FIG. 1 is a view showing a paper finishing device of an image forming apparatus according to the related art.
Figure 2:
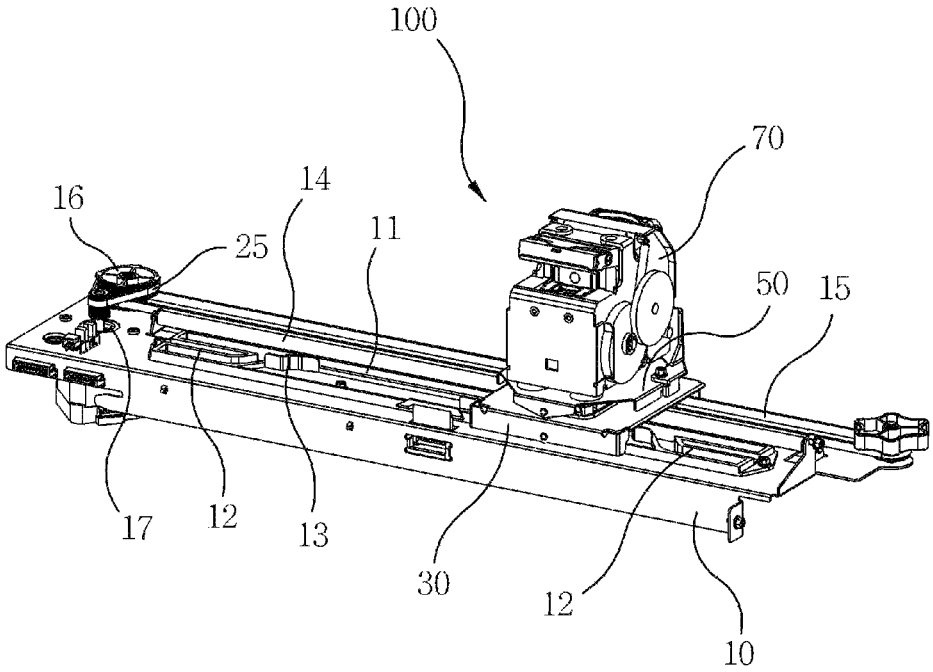
FIG. 2 is a perspective view showing a stapling apparatus according to the present invention.
Figure 3:
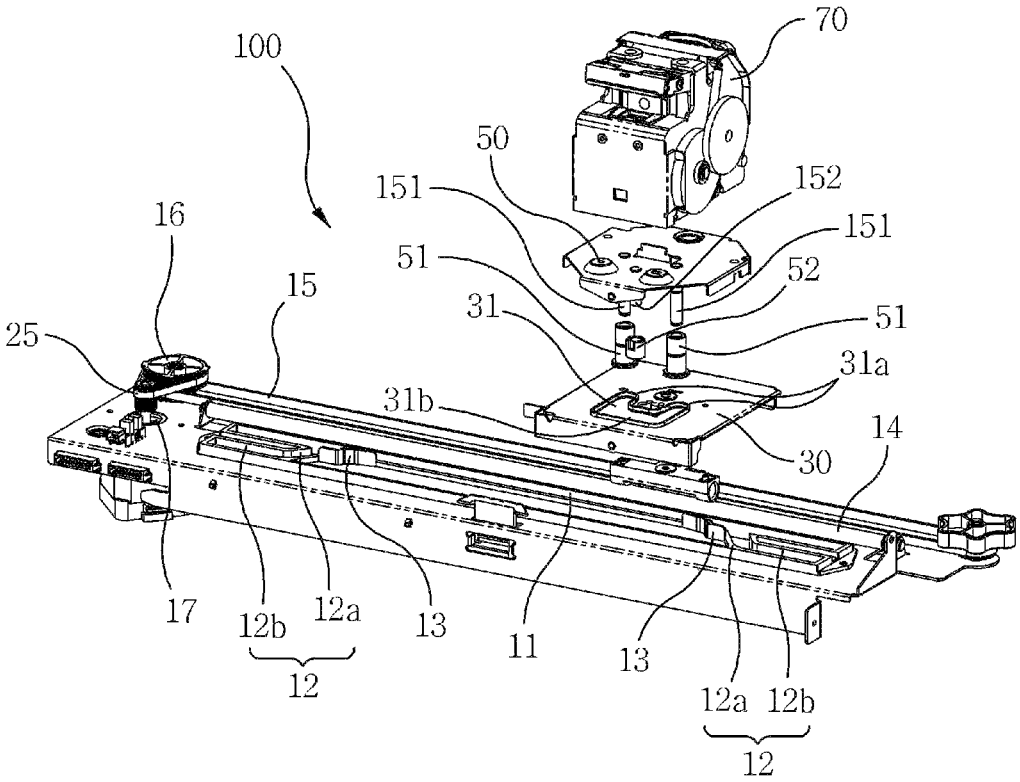
FIG. 3 is an exploded perspective view showing the stapling apparatus according to the present invention.
Figure 4:
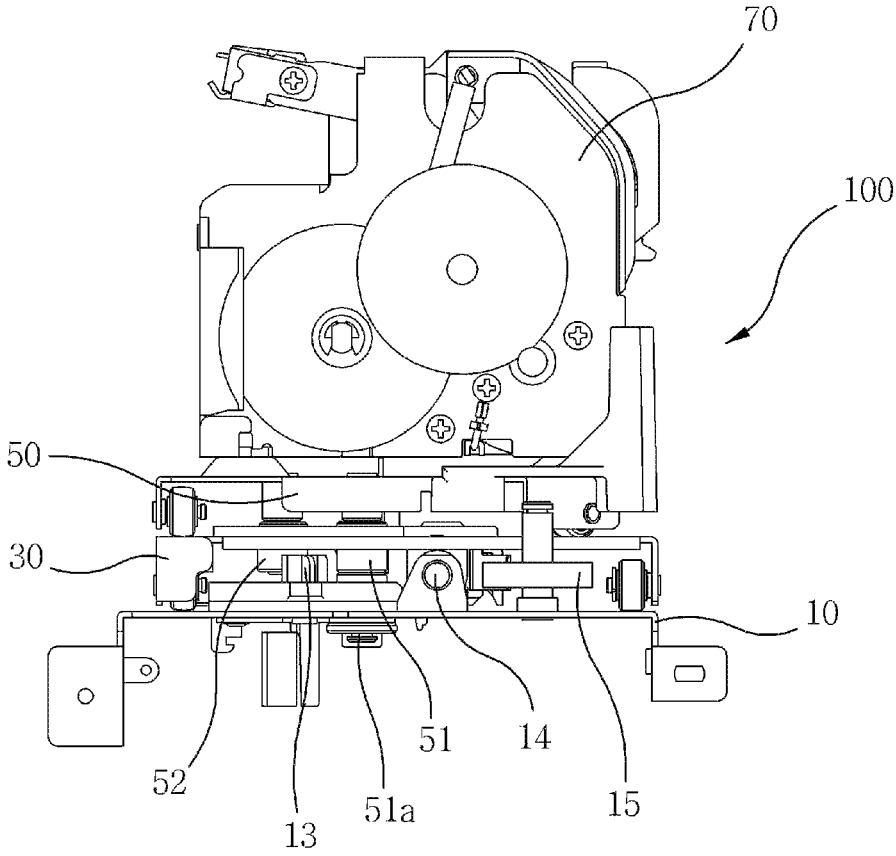
FIG. 4 is a side view showing the stapling apparatus according to the present invention.
Figure 5:
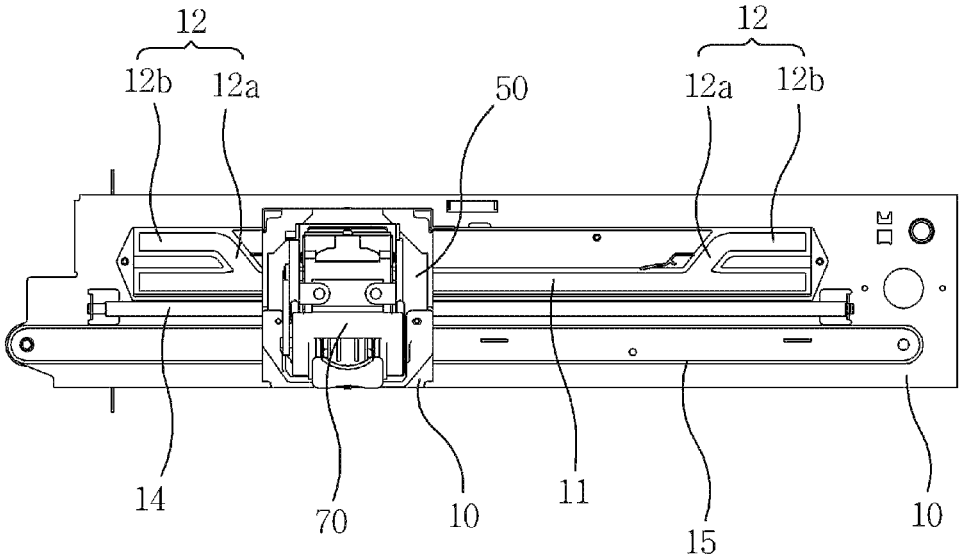
FIG. 5 is a plan view showing the stapling apparatus according to the present invention.
Figure 6:
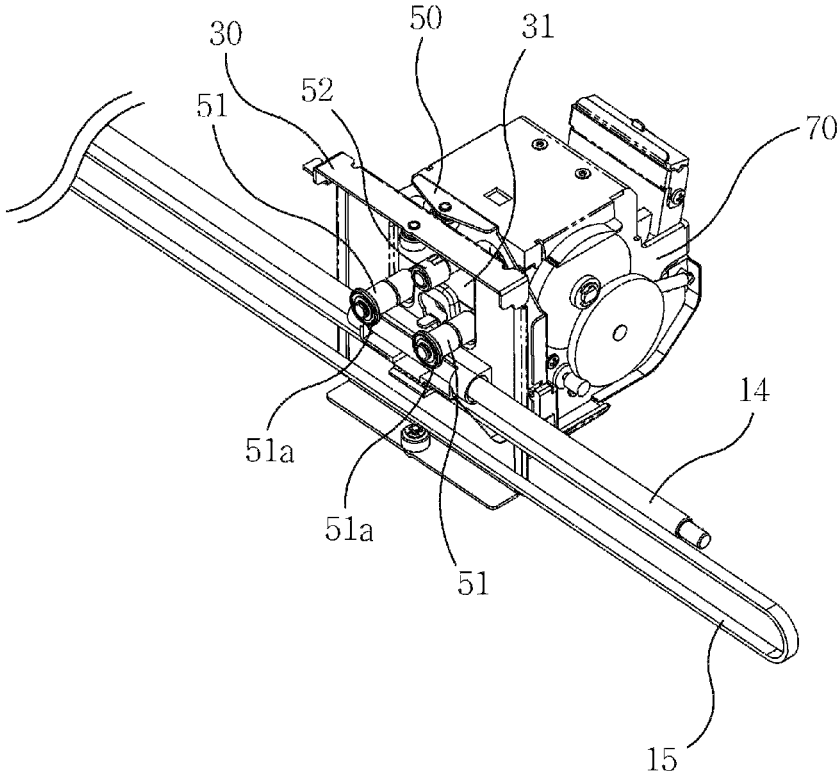
FIG. 6 is a perspective view showing main components of the stapling apparatus according to the present invention at the bottom side.

Hereinafter, the technical configuration and the technical operation of a stapling apparatus 100 according to the present invention will be described with reference to FIGS. 2 to 6.

The stapling apparatus 100 according to the present invention includes abase frame 10, a movable frame 30, a bucket 50 for rotating a stapler 70, and the stapler 70.

The base frame 10 includes a horizontal slot 11 incised in a longitudinal direction of the base frame 10 and having the form of a straight line, and branch slots 12 branched from inner portions of the horizontal slot 11 while being spaced apart from both end portions of the horizontal slot 11 by a predetermined distance. The branch slots 12 include inclined portions 12*a* inclined at about 45 degrees about the horizontal slot 11 and parallel portions 12*b* parallel to the horizontal slot 11. The branch slots 12 are symmetrical to each other.

The interval between the horizontal slot 11 and the parallel portion 12*b* of the branch slot 12 must be narrower than the interval between first guide rollers 51, which are described later, so that the first guide rollers 51 can simultaneously move along the branch slot 12 and the horizontal slot 11 while forming an angle of about 45 degrees.

Rotation restricting plates 13 protruding from the base frame 10 and having a predetermined shape are formed at the intersection between the horizontal slot 11 and the branch slot 12. The base frame 10 includes a movement guide shaft 14 parallel to the horizontal slot 11. In addition, the base frame 10 includes a driving belt 15 provided in parallel to the movement guide shaft 14 and rotatably installed. The driving belt 15 is coupled with a driving wheel 16 fixed onto the base frame 10. The driving wheel 15 is driven by the driving motor 17 through the driving belt 25.

Meanwhile, the movable frame 30 has one side fixed to the movement guide shaft 14 and an opposite side fixed to the driving belt 15 so that the movable frame 30 can slidably move to the left or right along the movement guide shaft 14 mounted on the base frame 10. In other words, the movable frame 30 can move to the left or right through the guide of the movement guide shaft 14 according to the rotation direction of the driving belt 15. A slot-type guide passage 31 having a substantially C shape and penetrating through the movable frame 30 is formed at the central portion of the movable frame 30 having the above structure. In the guide passage 31, both end portions 31*a* of the substantially C shape correspond to the horizontal slot 11, and a central portion 31*b* is provided outside the horizontal slot 11 to correspond to the straight line formed by the rotation restricting plates 13.

The bucket 50 for rotating the stapler includes one pair of first guide rollers 51 and one second guide roller 52 which are vertically installed in a substantially triangular shape at a lower portion of the bucket 50. The first guide rollers 51 are rotatably fitted around the shafts 151, respectively, and have steps 51*a* locked with lower edges of the horizontal slot 11 and the branch slot 12 to prevent the first guide rollers 51 from getting out of the base frame 10 when the first guide rollers 51 are fitted into the horizontal slot 11 through the guide passage 31 of the movable frame 30. The second guide roller 52 is fitted around the shaft 152, and protrudes toward the base frame 10 through the guide passage 31 formed in the movable frame 30.

The second guide roller 52 protruding toward the base frame 10 is positioned on a straight line formed by the rotation restricting plates 13 such that the second guide roller 52 makes contact with the rotation restricting plates 13. When the second guide roller 52 is positioned out of the region of the rotation restricting plates 13, the second guide roller 52 does not make contact with the base frame 10, but maintains the distance from the base frame 10.

A stapler 70 is fixed onto the bucket 50 for rotating the stapler 70.

Although not described in the present invention, anti-frictional rollers may be additionally mounted on bottom surfaces of the movable frame 30 and the bucket 50 for rotating the stapler 70 for the purpose of stable movement and smooth rotation.

Hereinafter, the operating procedure of the stapling apparatus 100 according to the present invention having the above structure will be described with reference to FIGS. 7A to 7C, and FIGS. 8A to 8C.

Figure 7A:
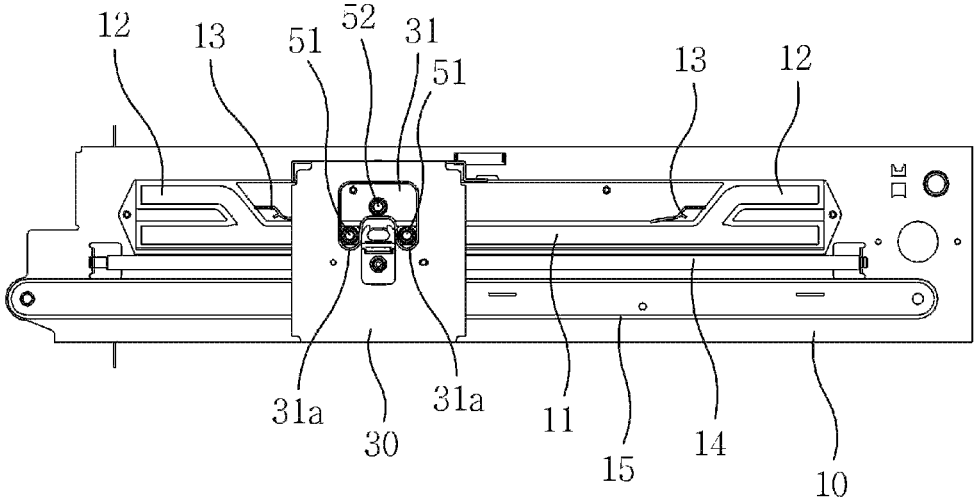
FIGS. 7A to 7C are views showing the positions of first and second guide rollers according to the position of a movable frame according to the present invention.
Figure 7B:
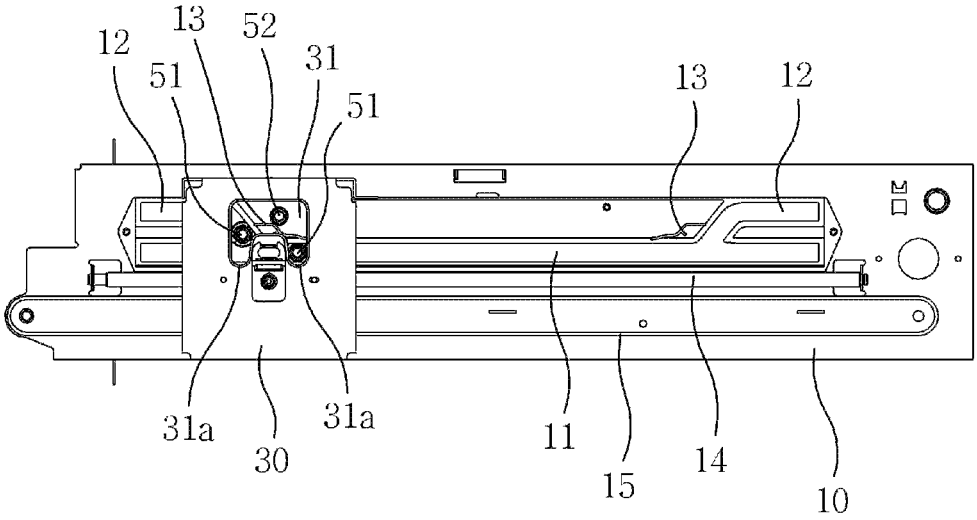
Figure 7C:
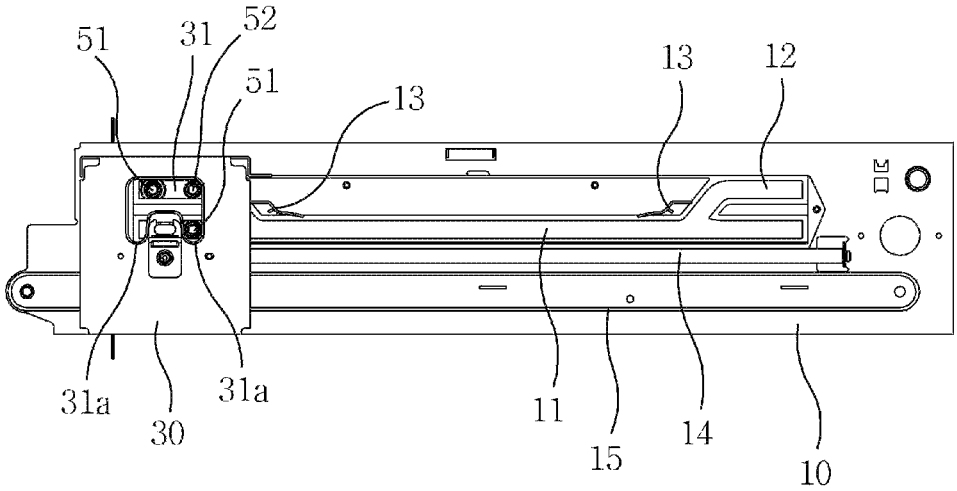

FIGS. 7A to 7C are views showing the positions of the first guide rollers 51 and the second guide roller 52 as the movable frame 30 moves to the left.

Figure 8A:
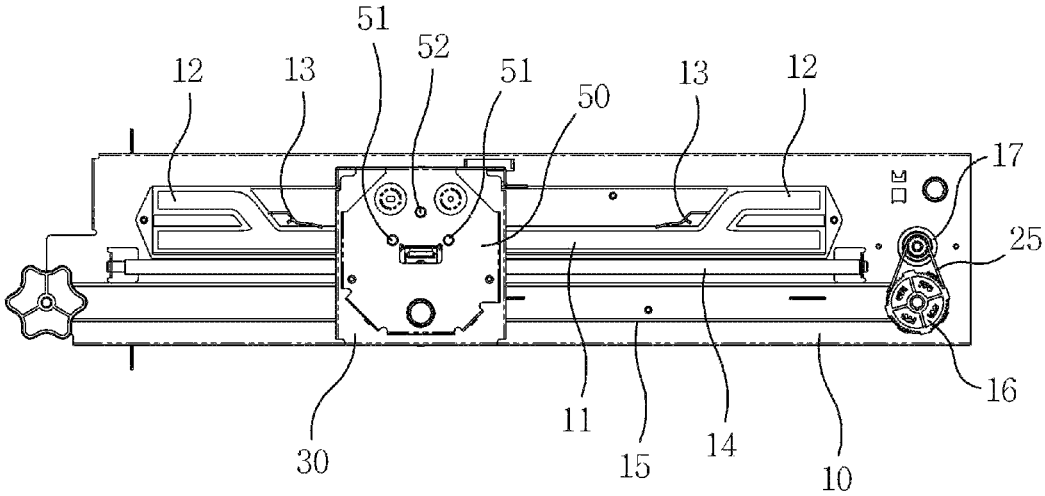
FIGS. 8A to 8C are views showing the rotational positions of a bucket for rotating a stapler corresponding to positions shown in FIGS. 7A to 7C.
Figure 8B:
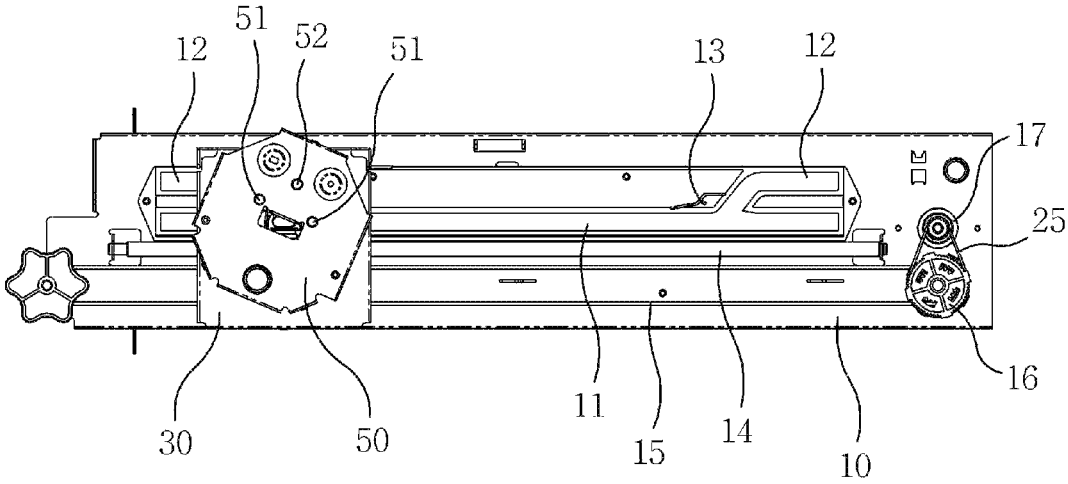
Figure 8C:
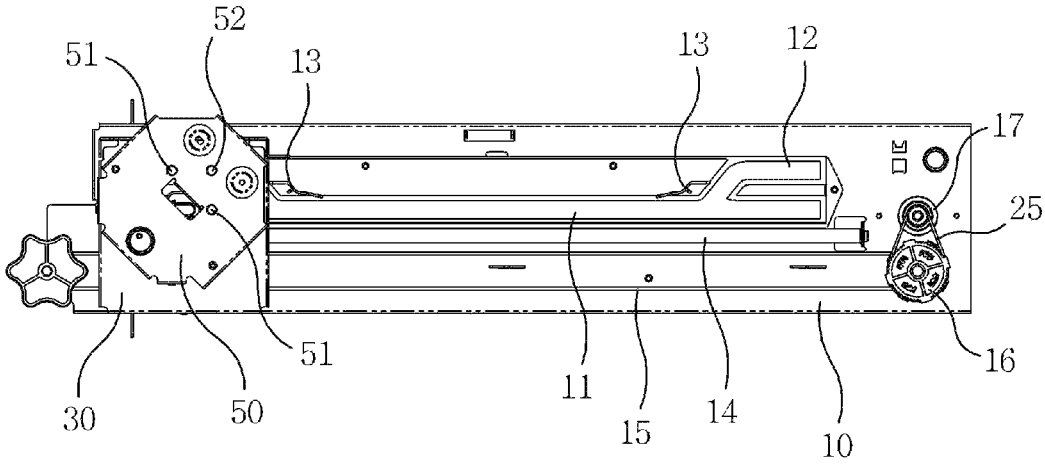

FIGS. 8A to 8C are views showing the rotation positions of the bucket 50 for stapling the stapler corresponding to positions shown in FIGS. 7A to 7C.

As shown in FIGS. 7A and 8A, when the movable frame 30 is positioned between the rotation restricting plates 13, the first guide rollers 51 fixed onto the lower portion of the bucket 50 are supported to the lower ends of the horizontal slot 11 through the both end portions 31*a* and the horizontal slot 11 of the movable frame 30, and the second guide roller 52 protrudes to the outside of the horizontal slot 11 through the central portion 31*b* of the guide passage 31 to maintain the distance from the base frame 10. When the first guide rollers 51 are positioned in both end portions 31*a* of the guide passage 31 of the movable frame 30, the first guide rollers 51 can move in the contact with the inner surfaces of the end portions 31*a* of the guide passage 31.

Subsequently, as shown in FIGS. 7B and 8B, if the second guide roller 52 of the bucket 50 makes contact with the rotation restricting plate 13 by moving the movable frame 30 to the left or right (the movable frame 30 is moved to the left in the present invention) as the driving belt 15 rotates, the bucket 50 rotates clockwise about the second guide roller 52 within the guide passage 31 of the movable frame 30 so that the first guide roller 51 positioned in a moving direction, that is, positioned at the left can be guided to the branch slot 12. The bucket 50 for rotating the stapler has a rotation angle of less than about 45 degrees in the state that the second guide roller 52 makes contact with the rotation restricting plate 13 as described above. However, if necessary, at the rotation angle of 45 degrees, the end portion of a paper may be stapled.

Then, as shown in FIGS. 7C and 8C, if the movable frame 30 is farther moved to the left side of the movable frame 30 in the state that the second guide roller 52 of the bucket 50 for rotating the stapler makes contact with the rotation restricting plate 13, the second guide roller 52 of the bucket 50 for rotating the stapler moves to the left side of the rotation restricting plate 13, the first guide roller 51 positioned at the left side moves along the branch slot 12, and the first guide roller 51 positioned at the right side moves along the horizontal slot 11.

Although the second guide roller 52 is spaced apart from the movable frame 30 to float in the air as the second guide roller 52 deviates from the region of the rotation restricting plate 13, since the first guide roller 51 positioned at the right side is positioned in the horizontal slot 11 when the first guide roller 51 makes contact with the inner surface of the end portion 31*a* provided in the guide passage 31 of the movable frame 30, and the first guide roller 51 positioned at the left side is positioned in the branch slot 12 when the first guide roller 51 makes contact with the side surfaces of the guide passage 31 of the movable frame 30 and the branch slot 12, the bucket 50 for rotating the stapler maintains the rotation angle of about 45 degrees.

The bucket 50 for rotating the stapler may have various rotation angles by properly adjusting the interval between the horizontal slot 11 and the branch slot 12, the interval between the first guide rollers 51 and the second guide roller 52, and the structure of the guide passage 31.

In the state that the bucket 50 for rotating the stapler is rotated at an angle of about 45 degrees as described above, the corner portion of a paper is stapled by using the stapler 70 fixed on the bucket 50 for rotating the stapler.

If the movable frame 30 is moved to the right by reversely driving the driving belt 15 in the state shown in FIGS. 7C and 8C, the positions of the first guide rollers 51 and the second guide roller 52 are recovered to the state of FIGS. 7B and 8B, and the state of FIGS. 7C and 8C.

Although the stapling apparatus according to the present invention has been described with reference to accompanying drawings, the present invention is not limited to the structure shown in the drawings and the description.

Therefore, it will be understood to those skilled in the art that various modifications, additions and substitutions are possible, without departing from the scope and spirit of the invention as disclosed in the accompanying claims.

What is claimed is:

1. A stapling apparatus comprising:

a base frame including:

a horizontal slot;

branch slots that branch from inner portions of the horizontal slot while being spaced apart from both end portions of the horizontal slot by a predetermined distance;

rotation restricting plates protruding from a branch portion between the branch slots and the horizontal slot, respectively; and a movement guide shaft provided in parallel to the horizontal slot;

a driving belt coupled with a driving wheel of a driving motor to rotate the driving belt while being installed parallel to the movement guide shaft;

a movable frame having one side fixed to the movement guide shaft and an opposite side fixed to the driving belt so that the movable frame is movable to a left or a right along the movement guide shaft mounted on the base frame and provided at a central portion of a horizontal plane thereof with a guide passage having a substantially C shape;

a bucket for rotating a stapler, in which a pair of first guide rollers fitted into the horizontal slot through both end portions of the substantially C-shape guide passage formed in the movable frame, and a second guide roller protruding to an outside of the horizontal slot through a central portion of the substantially C-shape guide passage formed in the movable frame are fixed to a lower portion of the bucket, and one of the first guide rollers moving along the horizontal slot is guided to move to the branch slot from the horizontal slot when the second guide roller makes contact with the rotation restricting plate so that the bucket is rotated to rotate the stapler; and a stapler coupled with and fixed onto the bucket for rotating the stapler while being mounted on the bucket, the stapler configured to perform stapling.

2. The stapling apparatus of claim 1, wherein the substantially C-shape guide passage formed in the movable frame is configured to restrict movement of the first guide rollers and one second guide roller fixed to the lower portion of the bucket for rotating the stapler.

3. The stapling apparatus of claim 1, wherein the substantially C-shape guide passage formed in the movable frame is configured to allow the first guide rollers to move while making contact with both end portions of the substantially C-shape guide passage when the second guide roller fixed to the lower portion of the bucket for rotating the stapler is positioned at the central portion of the substantially C-shape guide passage.

4. The stapling apparatus of claim 1, wherein each branch slot branching from the horizontal slot includes an inclined portion inclined with respect to the horizontal slot at a predetermined angle and a parallel portion parallel to the horizontal slot.

5. The stapling apparatus of claim 1, further comprising a driving belt installed on the base frame to rotate in parallel to the movement guide shaft, and the movable frame is fixed to the driving belt to reciprocate along the movement guide shaft.

6. The stapling apparatus of claim 1, wherein the second guide roller maintains a predetermined distance from the base frame if the second guide roller is positioned out of a region of the rotation restricting plate.

7. The stapling apparatus of claim 1, wherein the substantially C-shape guide passage formed in the movable frame is an angle change passage on which the pair of first guide rollers and one second guide roller fixed to the lower portion of the bucket are movable to rotate.

* * * * *